US009194206B2

(12) United States Patent
Xu et al.

(10) Patent No.: US 9,194,206 B2
(45) Date of Patent: Nov. 24, 2015

(54) EASY DRILL SLIP

(75) Inventors: Richard Yingqing Xu, Tomball, TX (US); Edward O'Malley, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 324 days.

(21) Appl. No.: 13/111,215

(22) Filed: May 19, 2011

(65) Prior Publication Data

US 2012/0292052 A1 Nov. 22, 2012

(51) Int. Cl.

| | |
|---|---|
| ***E21B 33/129*** | (2006.01) |
| ***E21B 23/01*** | (2006.01) |
| ***E21B 33/12*** | (2006.01) |
| ***E21B 33/134*** | (2006.01) |

(52) U.S. Cl.

CPC ..... *E21B 33/1204* (2013.01); *E21B 33/129* (2013.01); *E21B 33/134* (2013.01); *E21B 33/1293* (2013.01)

(58) Field of Classification Search

CPC ..... E21B 33/1292; E21B 33/129; E21B 33/1293; E21B 33/1204; E21B 23/01

USPC ..... 166/118–152, 179–202

See application file for complete search history.

(56) References Cited

U.S. PATENT DOCUMENTS

| | | | | |
|---|---|---|---|---|
| 2,204,659 | A * | 6/1940 | Burt | 166/217 |
| 2,546,377 | A * | 3/1951 | Turechek | 166/196 |
| 6,167,963 | B1 | 1/2001 | McMahan et al. | 166/179 |
| 7,051,806 | B2 * | 5/2006 | Dodd | 166/242.2 |
| 8,205,671 | B1 * | 6/2012 | Branton | 166/118 |
| 2002/0043368 | A1 * | 4/2002 | Bell et al. | 166/118 |
| 2003/0188876 | A1 * | 10/2003 | Vick et al. | 166/382 |
| 2010/0132960 | A1 * | 6/2010 | Shkurti et al. | 166/387 |

* cited by examiner

*Primary Examiner* — Blake Michener
*Assistant Examiner* — Kipp Wallace
(74) *Attorney, Agent, or Firm* — Shawn Hunter

(57) ABSTRACT

A design for a bridge plug wherein the slip elements include an outer contact portion to engage a surrounding tubular member and an inner body portion designed to easily disintegrate during removal of the bridge plug by subsequent milling. The inner body portion is formed of a softer material than the outer contact portion. Also, the inner body portion is made up of a plurality of segments that are readily separated and dispersed during milling out.

13 Claims, 6 Drawing Sheets

EASY DRILL SLIP

BACKGROUND OF THE INVENTION

1. Field of the Invention

The invention relates generally to the design of bridge plug slips.

2. Description of the Related Art

Bridge plugs are used to form closures in a flowbore. Often, a bridge plug will need to be removed, and this is done by milling through the plug. Unfortunately, milling through most conventional bridge plug designs leaves large pieces which may be difficult to circulate out of the flowbore.

SUMMARY OF THE INVENTION

The present invention provides a design for a bridge plug wherein the slip elements of the plug include a unitary, radially outer contact portion to engage a surrounding tubular member and an inner body portion that supports the outer contact portion under compression but which is designed to easily disintegrate during removal of the bridge plug by subsequent milling. In described embodiments, the inner body portion is formed of aluminum while the contact portion is formed of hardened cast iron. Also in described embodiments, the inner body portion is made up of a plurality of segments that are readily separated from one another and dispersed during a milling out operation. In accordance with particular embodiments, the slip elements are cast within a surrounding molding of phenolic material to create a slip ring which can be disposed upon a setting cone.

According to a further feature of the invention, a plurality of openings are disposed through the outer contact portion. The openings create points of weakness in the outer contact portion which assist in disintegration of the outer contact portion into smaller component parts.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
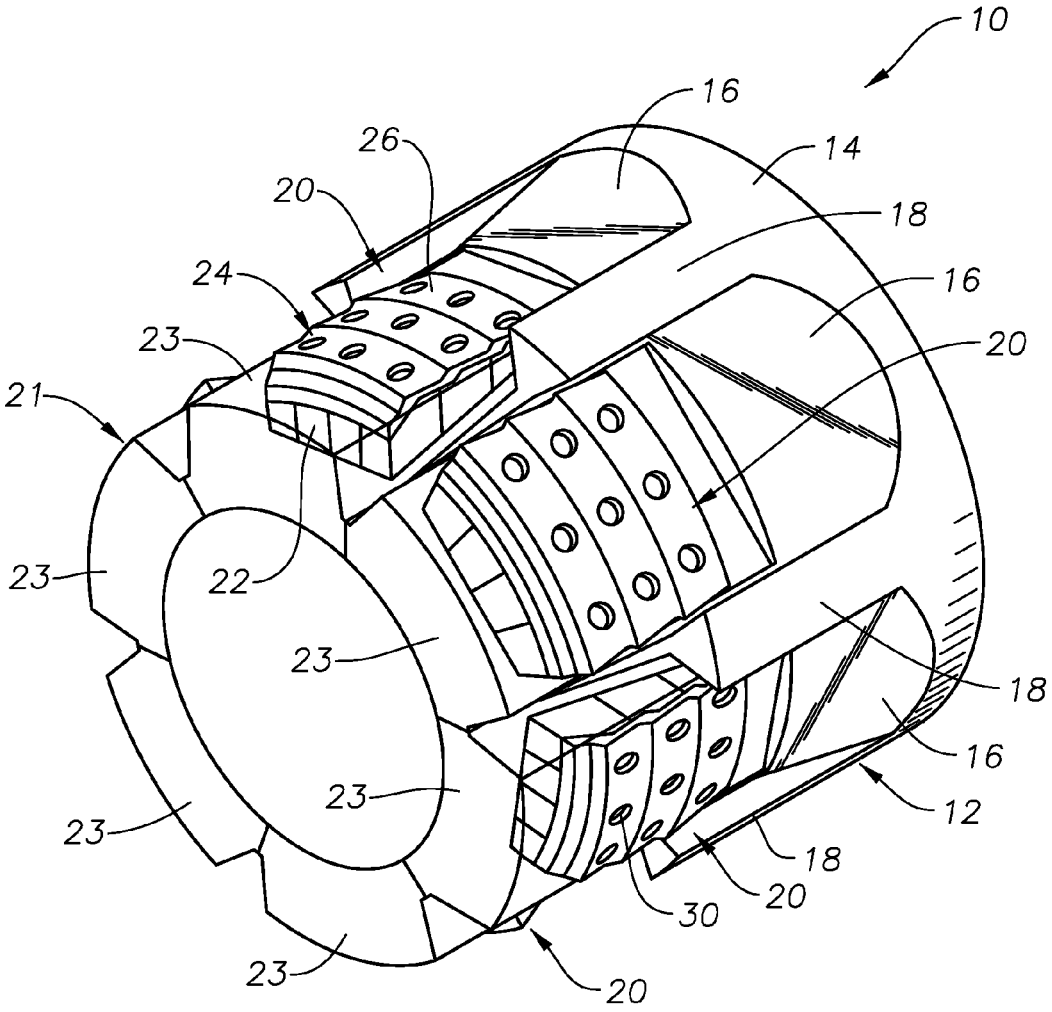
FIG. 1 is an isometric view of an exemplary bridge plug which incorporates slip elements constructed in accordance with the present invention.
Figure 2:
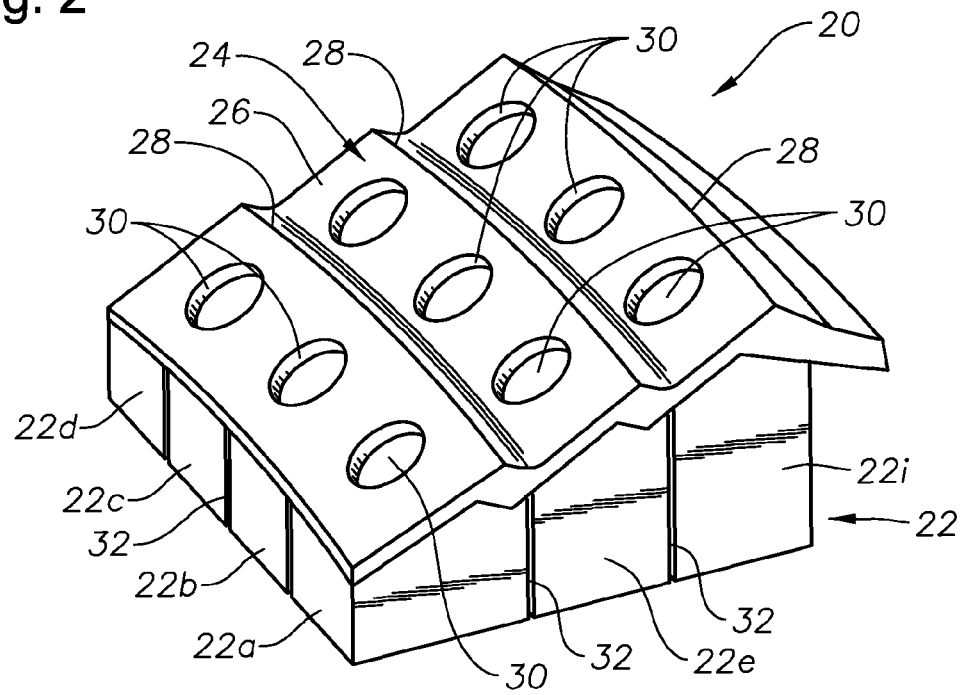
FIG. 2 is an isometric view of an exemplary slip element constructed in accordance with the present invention.
Figure 3:
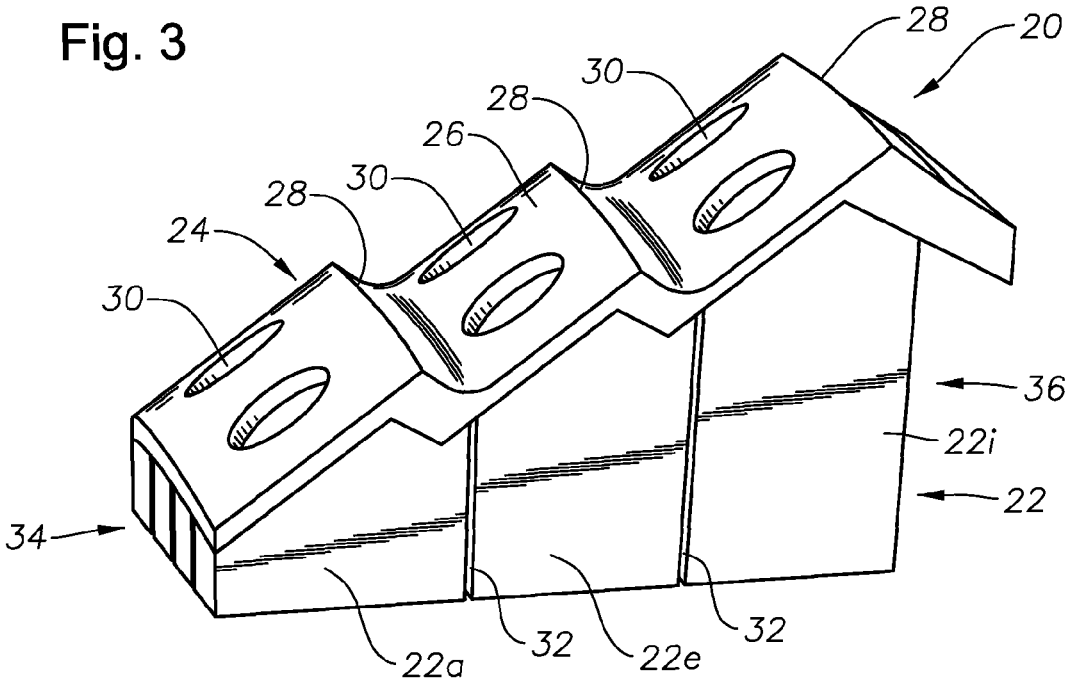
FIG. 3 is a side view of the slip element shown in FIG. 2.
Figure 4:
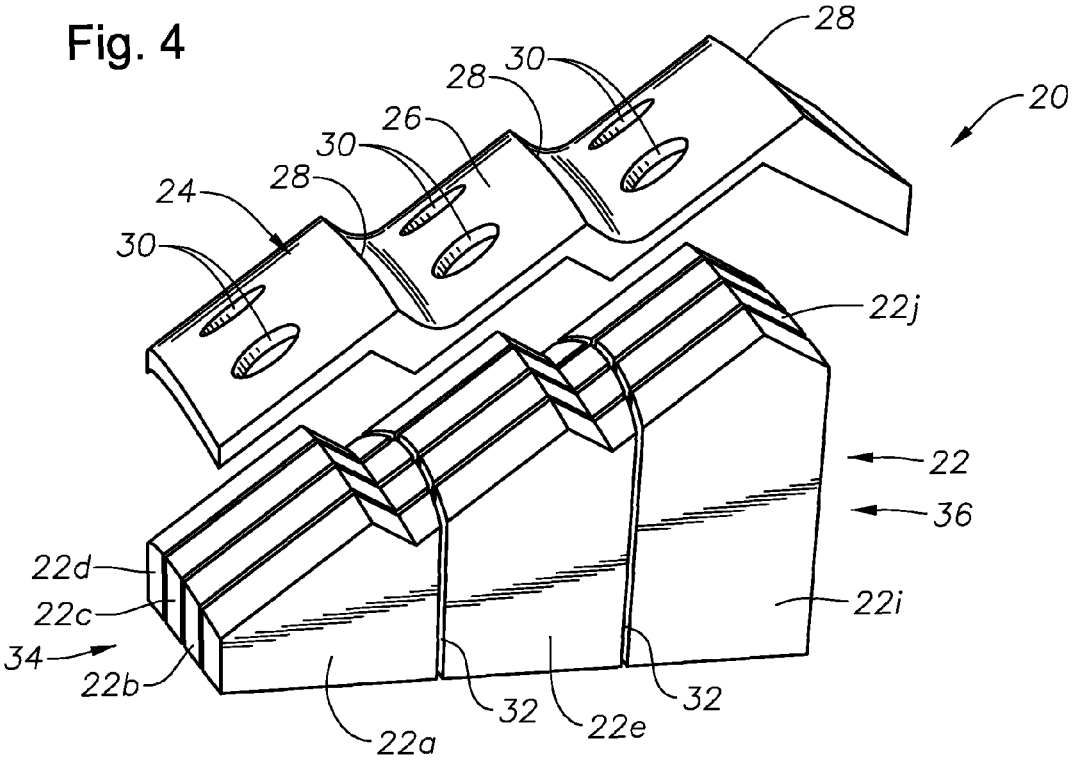
FIG. 4 is a partially exploded view of the slip element shown in FIGS. 2 and 3.
Figure 5:
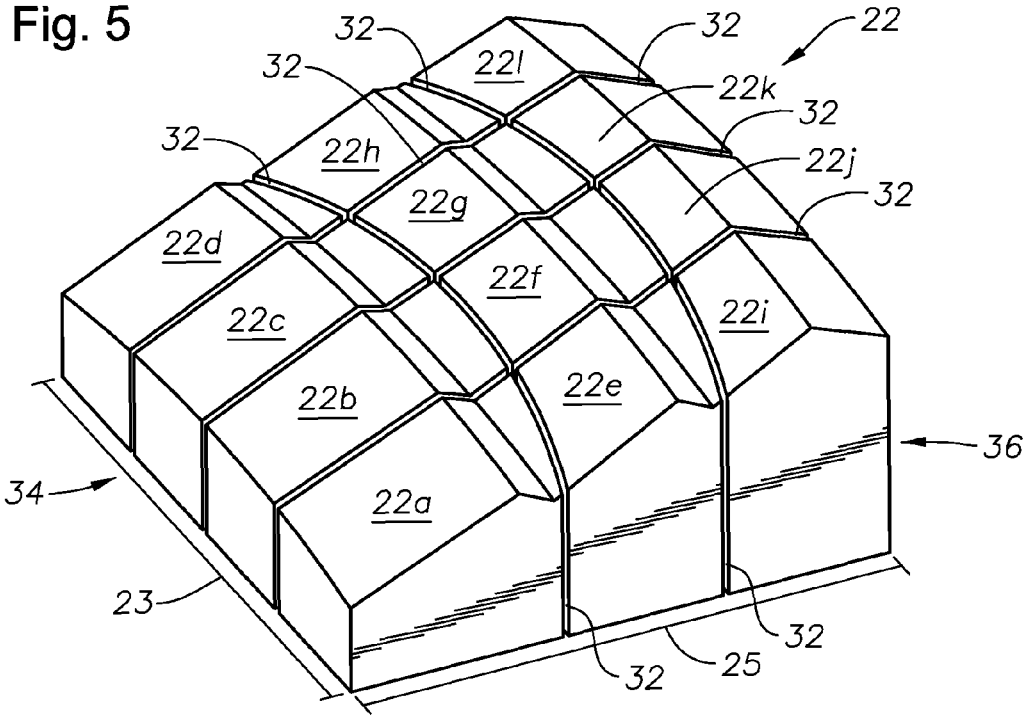
FIG. 5 is an isometric view of the inner body portion of the slip element.

FIG. 1 depicts an exemplary bridge 10 that is constructed in accordance with the present invention. It is noted that the term "bridge plug," as used herein, is meant to refer expansively to a class of devices that use radially moveable slip elements to be mechanically set within a flowbore, including locks, plugs, and anchors. The bridge plug device 10 includes a setting cone 12 which is generally cylindrical. The outer radial surface 14 of the setting cone 12 includes a plurality of angled ramps 16 which are separated by guides 18. A slip element 20, constructed in accordance with the present invention, is located upon each of the ramps 16.

Figure 6:
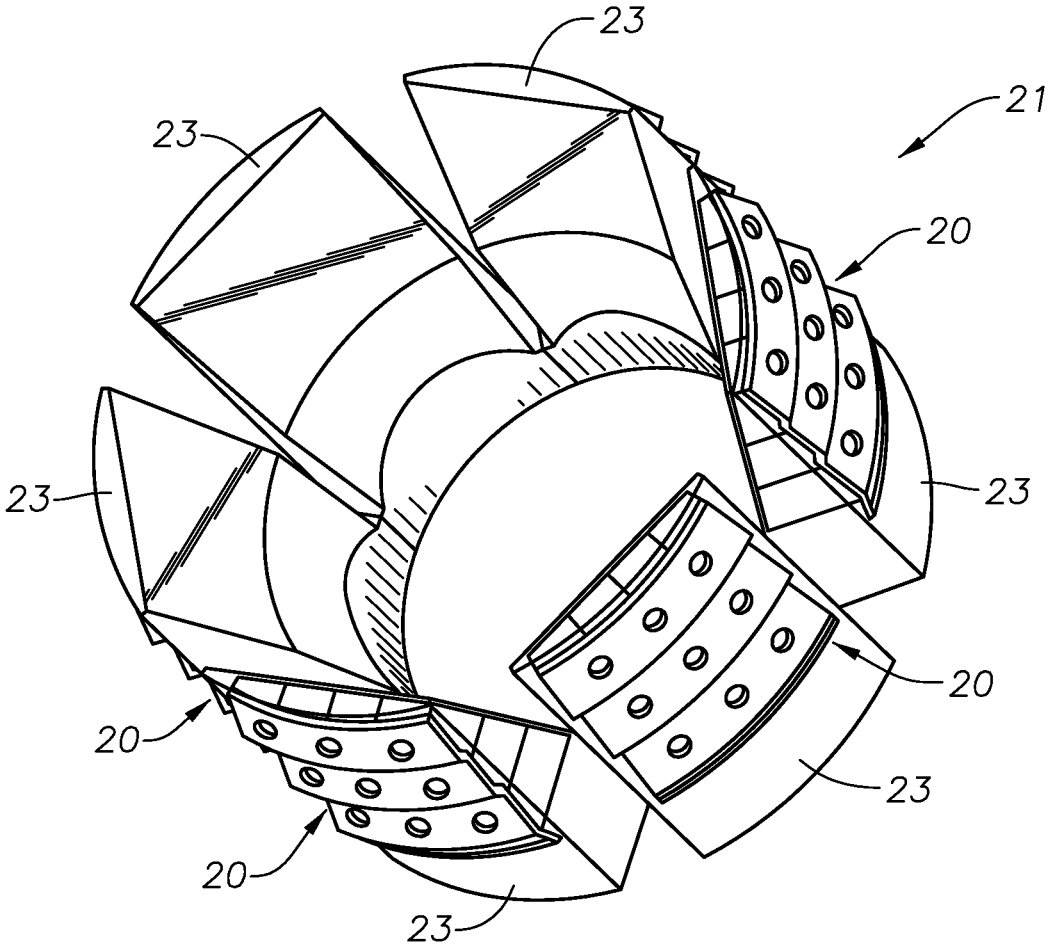
FIG. 6 is an isometric view of an exemplary slip ring molding used with the bridge plug shown in FIG. 1.

In preferred embodiments, the slip elements 20 are cast within a surrounding molding 21, which forms a slip ring that is best seen in FIG. 6. In particular embodiments, the molding 21 is formed of a phenolic resin and is cast in an annular ring shape having sheaths 23. The sheaths 23 each encase one of the slip elements 20. The molding 21 forms a slip ring which, as FIG. 1 illustrates, is disposed onto the setting cone 12 to form the bridge plug 10.

The slip elements 20 are moveable upon the ramps 16 between the retracted, unset position shown in FIG. 1 and a set position, wherein the slip elements 20 are moved upon the ramps 16, in a manner known in the art, radially outwardly with respect to the setting cone 12. In the set position, the slip elements 20 of the bridge plug 10 are brought into engagement with a surrounding tubular member.

The structure of the slip elements 20 is better appreciated with reference to FIGS. 2-5. Each slip element 20 is made up of an inner body portion 22 and an outer contact portion 24 which is supported by the inner body portion 22. The outer contact portion 24 presents an outer surface 26 which has wickers 28 formed thereupon. The outer contact portion 24 is preferably unitary and hardened, durable material. In particular embodiments, the outer contact portion 24 is formed of cast iron.

Figure 9:
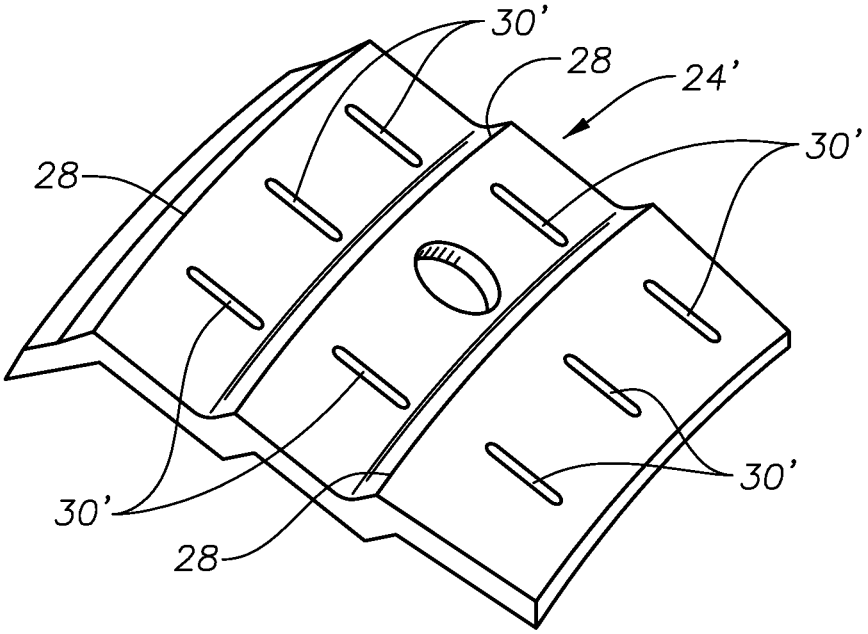
FIG. 9 is an isometric view of an alternative outer contact portion for a slip element in accordance with the present invention.

In a preferred embodiment, openings 30 are disposed through the outer contact portion 24. The openings 30 introduce points of weakness in the structure of the portion 24. Thus, they serve as stress risers which assist the outer contact portion 24 in disintegration during removal of the bridge plug 10 by drilling. FIG. 9 depicts an alternative embodiment for an outer contact portion 24' which has a similar construction to the outer contact portion 24. However, the openings 30' are in the form of elongated slots.

The contact portion 24 (or 24') preferably extends from the upper end 32 to the lower end 34 of the slip element 20. The outer contact portion 24 (or 24') is preferably affixed to the body portion 22 using a suitable adhesive.

In the depicted embodiment, the inner body portion 22 is made up of a plurality of separate segments. FIGS. 2-5 illustrate an example wherein twelve segments 22*a*, 22*b*, 22*c*, 22*d*, 22*e*, 22*f*, 22*g*, 22*h*, 22*i*, 22*j*, 22*k* and 22*l* make up the inner body portion 22. In particular embodiments, the segments 22*a*, 22*b*, 22*c*, 22*d*, 22*e*, 22*f*, 22*g*, 22*h*, 22*i*, 22*j*, 22*k* and 22*l* adjoin one another and are preferably arranged in an array of rows 23 and columns 25 to form a support for the outer contact portion 24 of the slip element 20. It is noted that the array need not be a uniform arrangement of equal sized pieces. Also, in certain embodiments, the segments are releasably secured to each other along seams 32 by a suitable adhesive. Also in particular embodiments, the outer contact portion 24 is affixed to the inner body portion 22 by a suitable adhesive. Thereafter, the slip elements 20 are cast within the slip ring molding 21.

Preferably, the inner body portion 22 is formed of a material that is softer, and thus more easily destroyed by abrasive drilling, than the material forming the outer contact portion 24. In particular embodiments, the inner body portion 22 is substantially formed of a light, high-strength aluminum which is easily destroyed by abrasive drilling.

Top surfaces of the segments 22*a*, 22*b*, 22*c*, 22*d*, 22*e*, 22*f*, 22*g*, 22*h*, 22*i*, 22*j*, 22*k* and 22*l* are shaped to interfit with the underside of the outer contact portion 24. The inner body portion 22 presents an axial first end 34 and an axial second end 36 that is opposite the first end 34. When the outer contact portion 24 is affixed to the inner body portion 22, the outer contact portion 24 extends substantially continuously from the first end 34 to the second end 36.

In operation, the bridge plug device 10 is run into a flowbore and then moved from its unset position to a set position, in a manner known in the art. The outer contact portions 24 of the slip elements 20 engagingly contact the surrounding tubular member.

Figure 8:
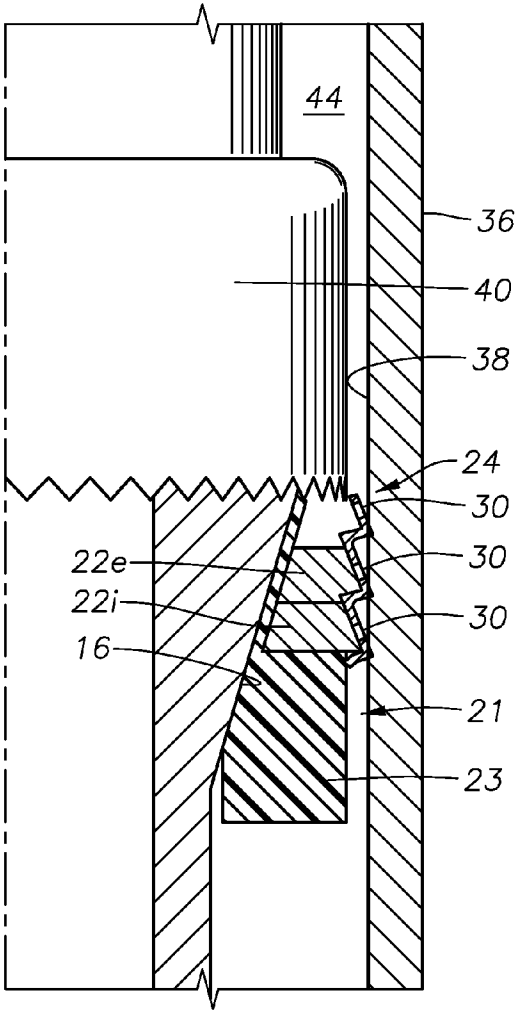
FIG. 8 is a one-quarter side cross-sectional view of the bridge plug member shown in FIG. 7, now being removed by milling.
Figure 7:
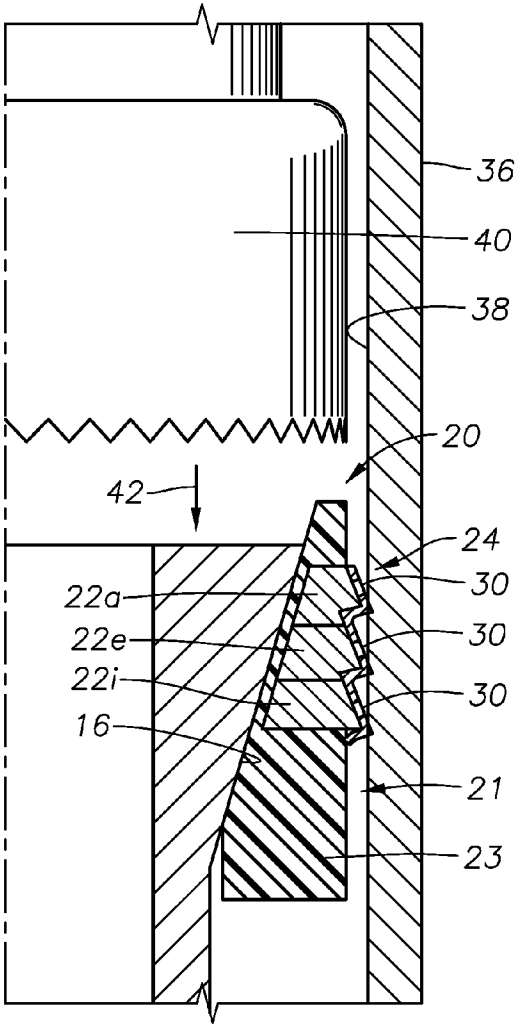
FIG. 7 is a one-quarter side cross-sectional view of an exemplary bridge plug in accordance with the present invention set within a surrounding tubular member.

When it is desired to remove the bridge plug device 10 from the flowbore, a milling device, of a type known in the art, contacts the bridge plug 10 and begins to destroy it by grinding action. As the milling device encounters the slip elements 20, the inner body portions 22 of the slip elements 20 are generally encountered first by the drilling/milling device, and the laminate of the slip ring 21 is ruptured and mechanically eroded away. FIGS. 7 and 8 depicts a bridge plug 10 which has been set within a surrounding tubular member 36 such that the wickers 28 of the slip elements 20 (one shown) are set into the interior surface 38 of the tubular member 36 in an engaging contact. A milling tool 40 is disposed within the tubular member 36 and moved in the direction of arrow 42 through flowbore 44 toward engagement with the upper end 46 of bridge plug 10. As FIG. 8 shows, the milling tool 40 then engages and begins to mill away the upper end 46 of the bridge plug device 10. The setting cone 12 is abraded away. As the milling tool 40 encounters the slip elements 20, the phenolic material forming the slip ring molding 21 is milled through, as depicted, thereby exposing the inner body portions 22. Because the inner body portions 22 are made up of separate individual segments 22*a*, 22*b*, 22*c*, 22*d*, 22*e*, 22*f*, 22*g*, 22*h*, 22*i*, 22*j*, 22*k* and 22*l*, the inner body portions 22 are easily destroyed. FIG. 8 depicts the upper body portion segments 22*a* (as well as 22*b* and 22*c*, not shown) having been removed by the milling device 40. Thus, the segments 22*a*, 22*b*, 22*c*, 22*d*, 22*e*, 22*f*, 22*g*, 22*h*, 22*i*, 22*j*, 22*k* and 22*l* are readily separated from each other and dispersed during the milling out operation.

In addition, the milling tool 40 will mill away the outer contact portions 24, and rupture the outer contact portions 24 into smaller component pieces due to the pattern of openings 30 which are disposed through the outer contact portions 24. During milling, as shown in FIG. 8, the outer contact portion 24 will rupture proximate the openings 30 to be broken up into smaller component pieces.

The design of the slip inserts 20 will permit the bridge plug device 10 to be rapidly removed from the flowbore 44. In addition, a number of the components of the bridge plug device 10 can be more easily circulated out of the flowbore 44.

Those of skill in the art will recognize that numerous modifications and changes may be made to the exemplary designs and embodiments described herein. The invention is limited only by the claims that follow and any equivalents thereof.

What is claimed is:

1. A slip element for a bridge plug device comprising:

an outer contact portion to provide engaging contact with a tubular member surrounding the bridge plug device;

an inner body portion in contact with the outer contact portion and formed of a plurality of separate segments that adjoin one another to form a support for the outer contact portion, the segments being separate from one another prior to the slip element being moved to a set position on the bridge plug device; and wherein the segments are arranged in an array of rows and columns.

2. The slip element of claim 1 wherein the segments are affixed to each other by an adhesive.

3. The slip element of claim 1 wherein the outer contact portion is substantially formed of cast iron.

4. The slip element of claim 1 wherein the inner body portion is substantially formed of aluminum.

5. The slip element of claim 1 wherein:

the outer contact portion is substantially formed of a first material; and the inner body portion is formed of a second material that is softer than the first material.

6. The slip element of claim 1 further comprising a plurality of openings formed through the outer contact portion to promote disintegration of the outer contact portion during milling out.

7. A bridge plug device for forming a closure within a flowbore, the bridge plug device comprising:

a setting cone;

a plurality of slip elements that are selectively moveable with respect to the setting cone between unset and set positions, each of the slip elements comprising:

an outer contact portion being formed of a first material suitable to provide engaging contact with a tubular member surrounding the bridge plug device; and an inner body portion in contact with the outer contact portion and formed of a plurality of separate segments, the segments being separate from one another prior to the slip element being moved to a set position on the bridge plug device, the separate segments being formed of a second material that is softer than the first material and wherein the segments are arranged in an array of rows and columns.

8. The bridge plug device of claim 7 wherein the plurality of segments adjoin one another to form a support for the outer contact portion.

9. The bridge plug device of claim 7 wherein:

the slip elements are cast within a phenolic molding.

10. The bridge plug device of claim 7 wherein the outer contact portion is substantially formed of cast iron.

11. The bridge plug device of claim 7 wherein the inner body portion is substantially formed of aluminum.

12. A method of removing a bridge plug that is set within a flowbore from the flowbore, comprising the steps of:

a) engaging a top portion of the bridge plug with a milling tool, the bridge plug having:

a setting cone;

a plurality of slip elements that are selectively moveable with respect to the setting cone between unset and set positions, each of the slip elements comprising:

an outer contact portion being formed of a material suitable to provide engaging contact with a tubular member surrounding the bridge plug;

an inner body portion in contact with the outer contact portion and formed of a plurality of separate segments that adjoin one another to form a support for the outer contact portion, the segments being separate from one another prior to the slip element being moved to a set position on the bridge plug device and wherein the segments are arranged in an array of rows and columns;

b) milling the inner body portion to separate and disperse the segments.

13. The method of claim 12 wherein the outer contact portion comprises a plurality of openings disposed therethrough and further comprising the step of:

milling the outer contact portion to cause the outer contact portion to rupture at the openings into smaller pieces.

* * * * *